United States Patent [19]

Zaehring et al.

[11] Patent Number: 4,740,138

[45] Date of Patent: Apr. 26, 1988

[54] DEVICE FOR CONTROLLING THE THROAT AREAS BETWEEN THE DIFFUSOR GUIDE VANES OF A CENTRIFUGAL COMPRESSOR OF A GAS TURBINE ENGINE

[75] Inventors: Gerhard Zaehring, Worthsee; Christian Prodehl, Martinsried, both of Fed. Rep. of Germany

[73] Assignee: MTU Motoren-und Turbinen-Munchen GmbH, Munich, Fed. Rep. of Germany

[21] Appl. No.: 937,676

[22] Filed: Dec. 4, 1986

[30] Foreign Application Priority Data

Dec. 4, 1985 [DE] Fed. Rep. of Germany ..... 3542762

[51] Int. Cl.[4] ..... F04D 29/46

[52] U.S. Cl. ..... 415/12; 415/46; 415/48

[58] Field of Search ..... 416/39; 415/12, 211, 415/144–145, 46, 48

[56] References Cited

U.S. PATENT DOCUMENTS

| | | | |
|---|---|---|---|
| 2,253,406 | 8/1941 | Wagner | 416/39 |
| 2,789,808 | 4/1957 | Blackman | 415/12 X |
| 3,038,698 | 6/1962 | Troyer | 415/12 |
| 3,356,289 | 12/1967 | Plotkowiak | 415/211 X |
| 3,367,570 | 2/1968 | Reichmann | 415/12 X |
| 3,756,739 | 9/1973 | Boussuges | 415/211 X |
| 3,764,227 | 10/1973 | Albertzart | 416/39 |
| 4,054,398 | 10/1977 | Penny | 415/12 X |
| 4,164,845 | 8/1979 | Exley et al. | 415/211 X |
| 4,228,753 | 10/1980 | Davis et al. | 415/211 X |
| 4,431,374 | 2/1984 | Benstein | 415/211 |
| 4,445,815 | 5/1984 | Fortmann | 415/12 |

FOREIGN PATENT DOCUMENTS

| | | | |
|---|---|---|---|
| 0040532 | 11/1981 | European Pat. Off. . | |
| 961742 | 4/1957 | Fed. Rep. of Germany . | |
| 1033966 | 7/1958 | Fed. Rep. of Germany | 415/12 |
| 1055882 | 4/1959 | Fed. Rep. of Germany | 415/12 |
| 2428969 | 1/1975 | Fed. Rep. of Germany . | |
| 2834860 | 3/1980 | Fed. Rep. of Germany . | |
| 3147334 | 4/1983 | Fed. Rep. of Germany | 415/211 |
| 68599 | 4/1982 | Japan | 416/39 |
| 211798 | 11/1984 | Japan | 415/211 |
| 870171 | 6/1961 | United Kingdom . | |
| 1126941 | 9/1968 | United Kingdom . | |
| 2085083 | 4/1982 | United Kingdom . | |
| 2084250 | 4/1982 | United Kingdom . | |
| 2102885 | 2/1983 | United Kingdom . | |
| 2104594 | 3/1983 | United Kingdom . | |
| 2149022 | 6/1985 | United Kingdom . | |

*Primary Examiner*—Everette A. Powell, Jr.
*Attorney, Agent, or Firm*—Barnes & Thornburg

[57] ABSTRACT

This device provides the diffusor guide vanes with bypass ducts which establish communication between the pressure and suction sides, which can be sealed by means of shut-off elements, which take the form of bimetal components or at least are connected to such a component, and which are deformed flap-fashion as a function of temperature.

13 Claims, 5 Drawing Sheets

Figure 1:
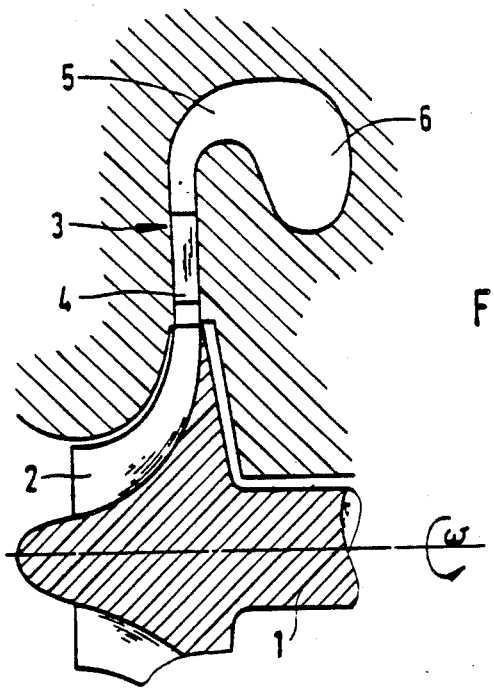

DEVICE FOR CONTROLLING THE THROAT AREAS BETWEEN THE DIFFUSOR GUIDE VANES OF A CENTRIFUGAL COMPRESSOR OF A GAS TURBINE ENGINE

The variable centrifugal compressor diffusor disclosed in German Patent Specification DE-OS 2428969 involves comparatively highly complex actuating means, where the respective flow or throat area between adjacent guide vanes is widened by untwisting the respective diffusor guide vanes to extend the range of characteristic compressor performance. In this previously disclosed case the diffusor vanes—when viewed from inside looking out—take a wedge-like, uniformly widening shape and are each pivotally variable about a journal arranged relatively far upstream. Joint vane actuation is achieved by means of a vane actuating shroud which can be rotated coaxially along the respective diffusor wall and which uses pins to engage in uniformly designed and arranged exit holes in the diffusor vanes.

Great complexity of actuating means, plus highly involved and overly sensitive diffusor vane construction, also embarrass a device disclosed in German Patent Specification No. DE-PS 3147334, on which the initially cited generic category is based, for the control of the throat areas between the diffusor guide vanes of a centrifugal compressor for gas turbine engines, where the diffusor guide vanes are provided with bypass ducts to establish communication between the vane pressure and suction sides. In this previously disclosed case the bypass ducts are controlled, or opened and closed, by means of gates traveling within the guide vanes to reach various extreme positions under combined lift/thrust motions.

Disclosed in German Patent Specification No. DE-PS 961742 is a vane, more particularly a gas turbine nozzle vane, which can be deformed with respect to its angle of incidence by virtue of the differing coefficients of thermal expansion of the materials of the pressure and suction side contour wall components. In this previously disclosed case, then, deformation involves the greater portion of the vane section geometry. In that respect the previously disclosed case essentially merely constitutes an alternative solution to turbine nozzle vanes requiring highly complex actuating means, without pointing a way towards essentially optimized and simplified control of the throat areas for a device of the initially cited generic category.

In a broad aspect of the present invention a device is provided which at extremely little mechanical complexity of actuating means and components is light in weight and which at extremely modest space requirement ensures accurate, reliable open or closed-loop control.

It is a particular object of the present invention to provide a device of the initially cited generic category which utilizes thermally responsive bimetal strips to control the measurement of the bypass duct control flap while maintaining smooth flow surfaces.

Bimetals obviously result from the union of two metal strips of differing thermal expansions (different coefficients of thermal expansion) joined together by, e.g., welding or bonding such that the strip combination will bend when the temperature changes.

The present invention thus represents a considerable jump forward in development over prior art when compared with the initially cited conventional diffusor actuating systems with their extreme complexity.

While the state of the art disclosed in German Patent Specification No. DE-PS 3147334 requires an extremely accurate, highly precise and expensive, "watchmaker's" type of manufacturing process for the diffusor vanes proper, as well as for the flap/gate combination integrated therein, the present invention provides a most simple means of optionally opening or closing the respective bypass ducts by way of bimetal flaps, where a special advantage is provided by the shut-off elements being stowed flush in the respective vane sections, so that the shut-off elements, when in this position, form a smooth-walled, stepless constituent part of an inner wall of the bypass duct. In the shut-off position the suction side of the vane can be locked in flush configuration. In either extreme position (bypass open/bypass closed), therefore, the shut-off elements cause no turbulence in the flow.

In accordance with the present invention all these benefits can be realized to best advantage without resorting to a complex mechanical vane actuating system especially attuned to differential thermal expansions of the components.

Further objects and advantages of the invention will become apparent from Claims 2 to 11.

Figure 2:
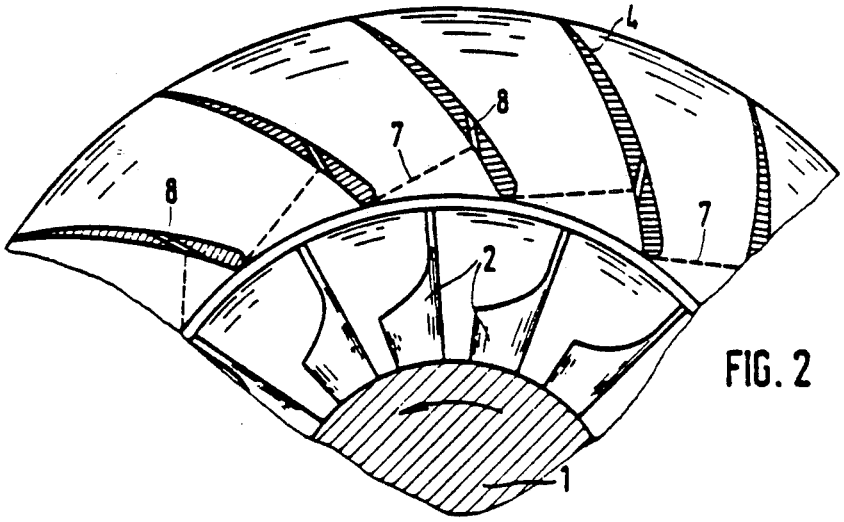
Figure 3:
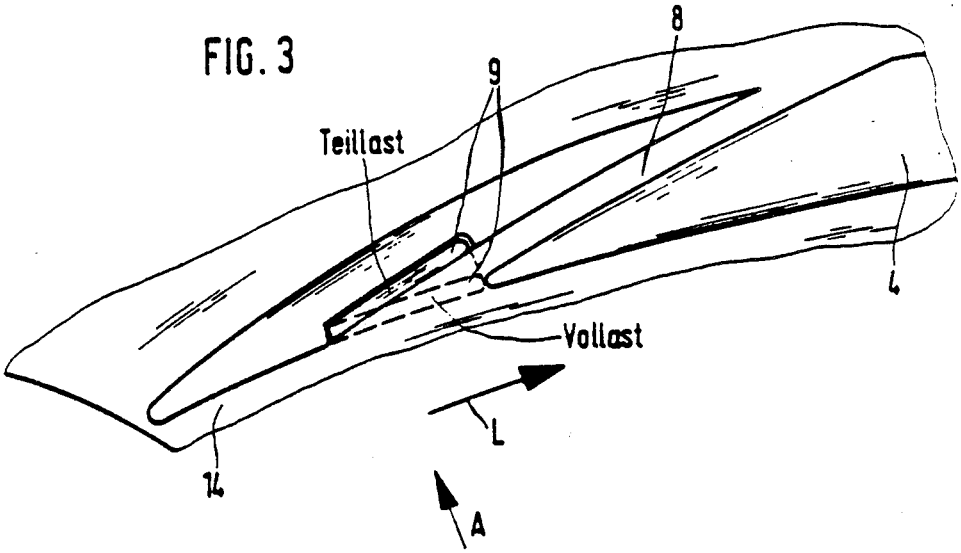
Figure 4:
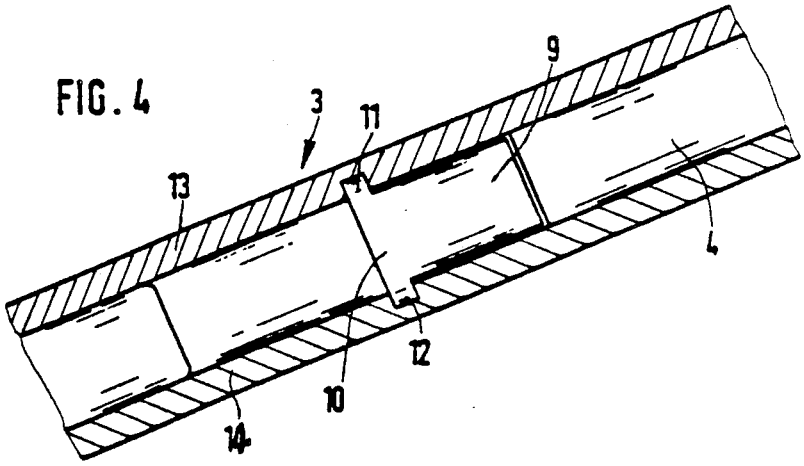
Figure 5:
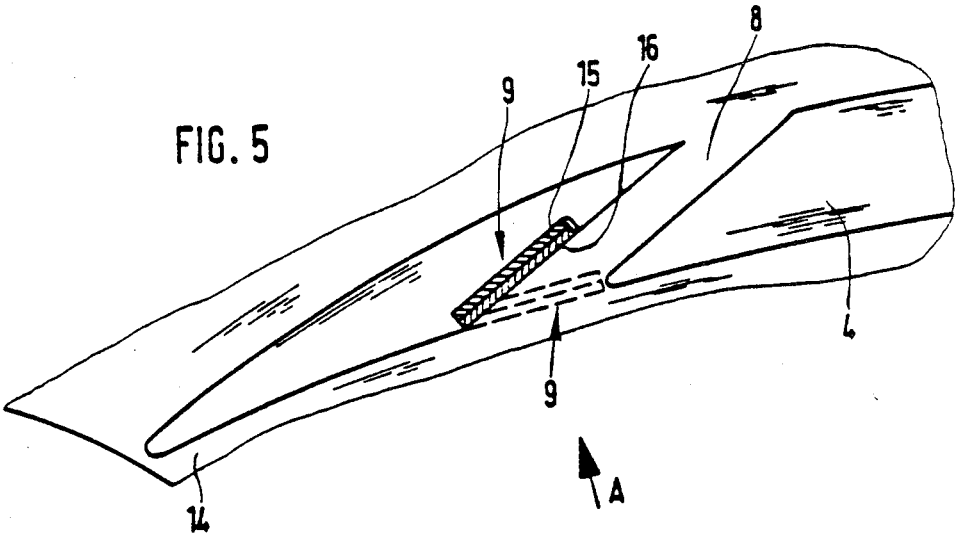
Figure 6:
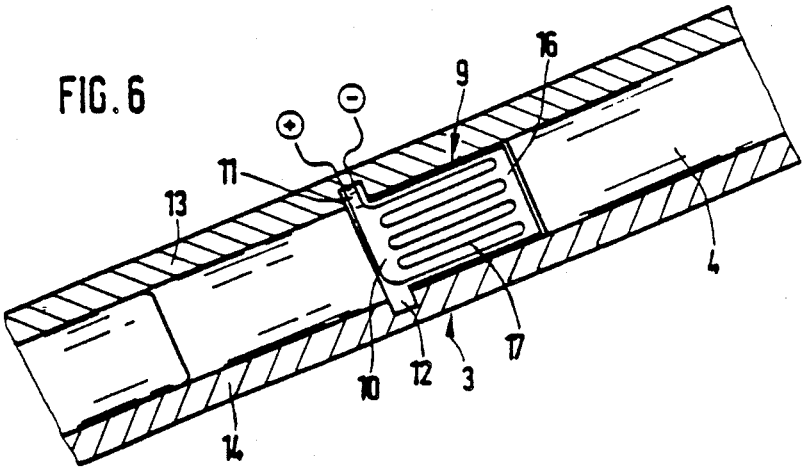
Figure 7:
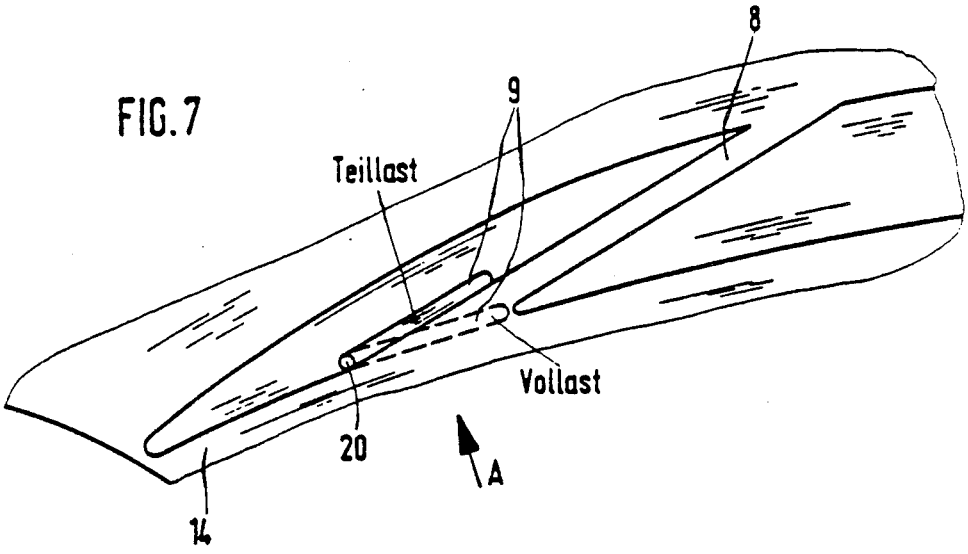
Figure 8:
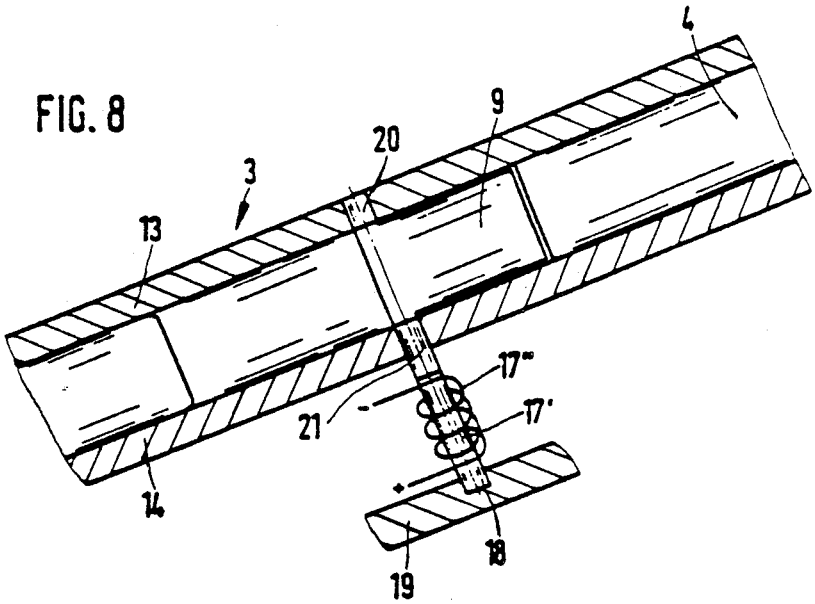
Figure 9:
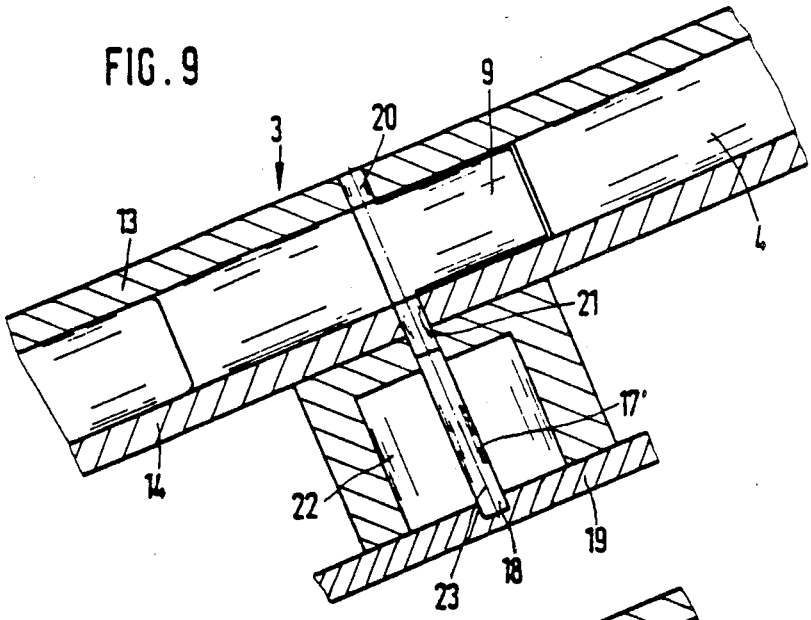
Figure 10:
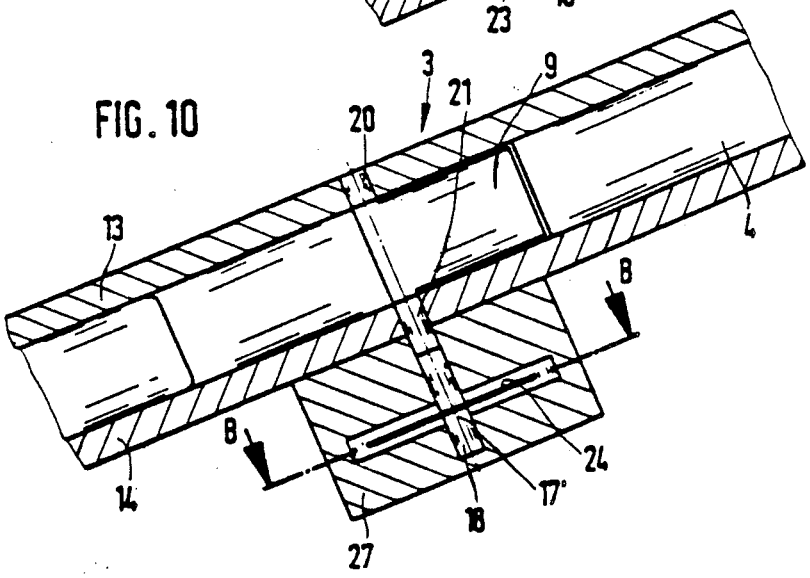
Figure 11:
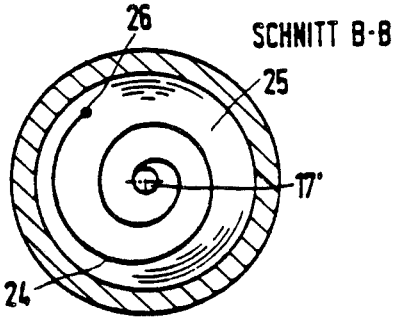

The invention is illustrated more fully in light of the accompanying drawings based on a centrifugal diffusor vane control concept for a gas turbine engine, in which FIG. 1 illustrates an axially parallel section of a centrifugal compressor section plus diffusor, FIG. 2 is an axially normal fragmentary sectional view of the compressor plus diffusor of FIG. 1, FIG. 3 illustrates in two different extreme positions, the afflux end of a diffusor guide vane plus a bimetal shut-off element as shown in FIG. 2, but here reproduced at a different incidence, FIG. 4 illustrates a diffusor section viewed on arrow A of FIG. 3, FIG. 5 is a representation analogous to that of FIG. 3, but here shows a heated, bimetal shut-off element, FIG. 6 illustrates a diffusor section viewed on arrow A of FIG. 5, FIG. 7 illustrates the afflux end of a diffusor guide vane reproduced analogously to that of FIGS. 3 and 5, but here incorporating a journal-type support for the shut-off element, FIG. 8 illustrates a diffusor section viewed on arrow A of FIG. 7 in relative arrangement with a bimetal journal section which at one end is rotationally fixed in the casing and is enveloped by a heating coil, FIG. 9 illustrates a diffusor section viewed on arrow A of FIG. 7 in relative arrangement with a bimetal journal section which at one end is rotationally fixed in the casing but in departure from FIG. 8, is arranged in a separate air chamber, FIG. 10 illustrates a diffusor section viewed on arrow A of FIG. 7 in relative arrangement with a journal which in departure from that of FIGS. 8 and 9, is pivotally supported in the casing to permit rotation in either direction and the one extreme section of which is here coupled to a bimetal coil in a disk-shaped space provided for the purpose, and FIG. 11 is a section taken at line B—B of FIG. 10.

With reference now to FIG. 1, a schematic arrangement of a centrifugal compressor stage includes a rotor 1 and attached thereto the centrifugal compressor rotor blades 2. Immediately following the centrifugal compressor rotor exit is a centrifugal diffusor 3 with centrifugal diffusor guide vanes 4, where the centrifugal diffusor 3 issues at its exit end into a tubular bend 5 communicating with a scroll housing 6 to duct the compressed air to a gas turbine engine combustion chamber, which is omitted on the drawing. The centrifugal compressor rotor 1, then, turns the externally provided input energy of the shaft into potential and kinetic energy of the gas. In the diffusor 3 with its vanes 4 the kinetic energy is then decelerated and partially converted into potential energy (pressure). Said deceleration is controlled by the contour of the diffusor vanes 4. The minimum throughput is limited by the the diffusor throat areas 7 (FIG. 2). When the bypass ducts 8 are opened, the respective diffusor throat area 7 accordingly is widened and the throughput is augmented.

With reference now to FIGS. 3 and 4 the shut-off elements 9 of the bypass ducts 8 are bimetal components which in a first extreme position (part-load position/-bypass flow area completely open) are stowed flush in a recess in a forward vane section. In a second extreme position (full-load position/bypass flow area fully closed) the shut-off element is to lock the suction side of the vane in flush configuration. In the process, control of the diffusor throat areas 7 can be continuous in relation to the given deformation or transition temperature. Deformation of the shut-off element 9 from the partial-load into the full-load position (shown in broken line) can accordingly be effected when a preselected temperature threshold of the compressor air L entering the diffusor 3 is exceeded. Then when the temperature drops below the preselected threshold, the shut-off element 9 is redeformed to assume the first, or partial-load position.

In accordance with FIG. 4 the shut-off elements 9 can—in the case of a cast diffusor—be integrally cast at a forward end 10 unaffected by control deformation and through bilaterally radially projecting extreme sections 11, 12 with adjacent structural casing portions or guide wall sections 13, 14 of the diffusor 3, or—in the case of a fabricated diffusor—they can be fixedly connected to these sections 13, 14 by locally imbedding them. Accordingly the shut-off elements 9 are here partially locally fixed in a plane extending in parallel with the end face; with reference to this plane the shut-off elements can therefore be selectively deformed flap-fashion in correspondence with a continuous control motion produced as a function of an operationally induced over-maximum or under-minimum temperature condition of, e.g., the incoming compressor air S.

The shut-off elements 9 can also be locally fixed without difficulty along the entire end 10 which extends in parallel with the end face and is not involved in the control deformation (FIG. 4).

Generally, then, the shut-off elements 9 (FIGS. 3 and 4) can be designed to respond with deformation to a certain variation in the compressor air temperature of a gas turbine engine.

With the variant of FIGS. 5 and 6, which is a more fully developed version of that in FIGS. 3 and 4, the over-maximum or under-minimum temperature to trigger deformation can be achieved also by electrically heating the flap-like bimetal shut-off element 9. In the stowed, partial-load position, which is shown in solid line, the two metal strips indicated by the numerals 15, 16 have extremely differing coefficients of thermal expansion. For electrical heating, use can be made, e.g., of a heating coil 17 wound on one side of the respective shut-off element 9 (FIG. 6). More particularly, and as here illustrated, the electrically insulated heating coil 17 can be mounted on the outside of the metal strip 16, which here is provided with an extremely low coefficient of thermal expansion. Alternatively the heating coil 17 could readily be integrated into the shut-off element.

In lieu of the heating coil 17 as here described and illustrated, use can be made also of an electrically heated rod for a similar deforming function. The respective heating rod could be arranged in a bore of a journal or its extension. In this arrangement the shut-off element can be designed as a "true" pivotable flap.

FIGS. 7 and 8 illustrate a further advantageous variant, where a journal section or extension 17' is designed as a bimetal component, with the one journal end 18 being fixedly arranged on the casing or a further casing section 19, while the remaining portion 20, 21 is pivotally supported in the guide walls 13, 14. FIG. 8 also illustrates a stationary electrical resistance heating coil 17'' uniformly helically wound around the respective journal extension 17'.

With reference to FIG. 9 the respective journal extension 17' may be installed in a common annular chamber for all journals or in an associated separate chamber 22, where the annular chamber or the respective separate chamber is energized with process air which is taken from the cycle and the temperature of which is adapted to suit the desired deformation transition point. In this arrangement the shut-off element 9 can again be pivotally supported along the journal sections 20, 21 an the diffusor guide walls 13, 14, and the extension 17' of the journal may again be a bimetal component; the end 18 of the extension 17' can fixedly be connected to the casing section 19.

Said annular chamber or the separate chambers 22 (FIG. 9) may be arranged coaxially to the engine centerline.

In a further advantageous aspect of the present invention the separate chambers 22 are arranged rotationally symmetrically to the respective journal centerline 23, as shown in FIG. 9.

Using the same reference numerals as in FIGS. 8 and 9 for essentially unchanged components, FIGS. 10 and 11 illustrate a variant where the bimetal component takes the form of a coil 24 enveloping the journal or its extension 17' and where the coil 24 is located at its one end on the journal extension 17' and at its other at point 26 in the separate chamber 25 formed by the casing (FIG. 11). In accordance with FIG. 10, then, the shut-off element 9 is pivotally supported both in the diffusor guide walls, via journal sections 20, 21, and on the casing body 27 (FIG. 10) forming the separate chamber 25, via the one extreme journal end 18.

Especially advantageous control of the throat areas 7 (FIG. 2) is achieved in adaptation to engine variables under the aero-thermodynamic cycle in that the deformation transition temperature provided by the air or heating provisions can be controlled by an engine control unit.

Particularly advantageous and effective application of the device is afforded by the possibility of manufacturing the bimetal components in nickel manganese steel (high thermal expansion) on the one hand, and in nickel steel (low thermal expansion) on the other.

In accordance with FIGS. 5 to 8, e.g., the flap-like shut-off elements 9 (FIGS. 5 and 6) or their actuating components (FIG. 8), which would here be typified by the respective journal extension 17', can be integrally connected at their respective fixation end 10 to the respective adjacent stator sections 13, 14 (FIG. 6) or 19 (FIG. 8). In a manner omitted on the drawings the inventive concept naturally also embraces the option of integrally connecting one end of the shut-off elements performing the respective control or shut-off function to an associated stationary vane section.

As previously already indicated by analogy the shut-off elements serving the control function can be cast integrally with adjacent structures of the casing of the engine or compressor already at the time the respective device is manufactured, with allowance made for minimum clearances along the shut-off element to be deformed, starting with its connecting end, until the desired amount of deformation is achieved.

What is claimed is:

1. A duffusor guide vane construction for a radial compressor of a gas turbine engine or the like turbo machinery, comprising:

a diffusor guide vane which exhibits a pressure side and a suction side when in an in-use position in a turbo machine, a bypass duct extending through the diffusor guide vane for communicating the pressure side with the suction side, said bypass duct including a recess, and a thermally responsive control flap means mounted at the recess in the bypass duct, said control flap means being operable in dependence on engine operating induced temperature conditions to be automatically moveable between a bypass duct blocking position where it forms a continuous surface closing the inlet end of the bypass duct and a bypass duct opening position where it is fully retracted into the recess means to form part of a continuous open duct, wherein said movement of the control flap means is controlled by thermally responsive bimetal components.

2. A diffusor guide vane construction according to claim 1, wherein the bimetal components are deformed by a preselected variation in compressor temperature.

3. A diffusor guide vane construction according to claim 1, comprising electrical heating means for inducing the temperature condition by electrically heating the bimetal components.

4. A diffusor guide vane construction according to claim 3, wherein said electrical heating means include an electrical heating coil which is wound on the respective bimetal components.

5. A diffusor guide vane construction according to claim 3, wherein said electrical heating means include an electrical heating coil which is integrated into the bimetal components.

6. A diffusor guide vane construction according to claim 1, wherein said control flap means is supported on a journal means including bimetal components, and wherein one journal means end is fixedly arranged in an engine casing while the other end is pivotably supported in the engine casing.

7. A diffusor guide vane construction according to claim 6, wherein a heating rod is arranged in a axial bore of the journal means.

8. A diffusor guide vane construction according to claim 6, wherein the journal means extends into a chamber which is energized with process air which is taken from the engine cycle at the temperature which is adapted to suit the desired deformation transition point.

9. A diffusor guide vane construction according to claim 1, wherein the control flap means is supported on journal means, wherein the bimetal components take the form of a coil enveloping the journal means, wherein the respective control flap means is pivotably supported, at both ends, and wherein the coil is connected at its one end to the journal means and is located at its other end at a point within a separate chamber accommodating the coil.

10. A diffusor guide vane construction according to claim 1, wherein an engine control unit controls the deformation transition temperature at which the control flap means moves between the bypass duct blocking and opening positions.

11. A diffusor guide vane construction according to claim 1, wherein the guide vane is part of a cast diffusor, wherein the control flap means take the form of control shut-off flaps integrally cast at one end unaffected by control deformation with adjacent structural casing components of the diffusor.

12. A diffusor guide vane construction according to claim 1, wherein the guide vane is part of a fabricated diffusor, and wherein the control flap means are fixedly connected to the adjacent structural casing by local imbedding.

13. A diffusor guide vane construction according to claim 1, wherein the bimetal components are manufactured using nickel manganese steel having high thermal expansion and nickel steel having little thermal expansion.

* * * * *